US008752903B2

(12) United States Patent
Ponticelli

(10) Patent No.: US 8,752,903 B2
(45) Date of Patent: Jun. 17, 2014

(54) CHAIR, CONVERTIBLE INTO A BABY'S HIGHCHAIR

(75) Inventor: Pius Ponticelli, Kappel (CH)

(73) Assignee: Brevi S.R.L., Telgate (IT)

( * ) Notice: Subject to any disclaimer, the term of this patent is extended or adjusted under 35 U.S.C. 154(b) by 352 days.

(21) Appl. No.: 13/085,818

(22) Filed: Apr. 13, 2011

(65) Prior Publication Data

US 2011/0254336 A1 Oct. 20, 2011

(30) Foreign Application Priority Data

Apr. 15, 2010 (IT) ..... MI2010A0640

(51) Int. Cl.
*A47C 1/11* (2006.01)
*A47D 1/00* (2006.01)

(52) U.S. Cl.
USPC ..... 297/467; 297/353; 297/344.18

(58) Field of Classification Search
USPC ..... 297/148, 152, 153, 338, 340, 344.1, 297/337, 467, 353, 344.14, 344.18
See application file for complete search history.

(56) References Cited

U.S. PATENT DOCUMENTS

| | | | | |
|---|---|---|---|---|
| 2,535,212 | A * | 12/1950 | Johnson | 297/149 |
| 6,024,412 | A * | 2/2000 | Kain et al. | 297/467 |
| 6,126,236 | A | 10/2000 | Wu | |
| 6,752,460 | B2 * | 6/2004 | Looser | 297/338 |
| 6,945,606 | B2 * | 9/2005 | Ponticelli | 297/337 |
| 6,957,861 | B1 * | 10/2005 | Chou et al. | 297/284.7 |
| 8,152,239 | B2 * | 4/2012 | Opsvik | 297/256.15 |
| 2008/0116723 | A1 * | 5/2008 | Asbach et al. | 297/153 |
| 2008/0179922 | A1 * | 7/2008 | Troutman et al. | 297/135 |

FOREIGN PATENT DOCUMENTS

| | | |
|---|---|---|
| CN | 201104671 Y | 8/2008 |
| WO | WO 2007/097638 A2 | 8/2007 |

* cited by examiner

*Primary Examiner* — David R Dunn
*Assistant Examiner* — Timothy J Brindley
(74) *Attorney, Agent, or Firm* — Scully, Scott, Murphy & Presser, P.C.

(57) ABSTRACT

A chair, convertible into a baby's highchair, comprising a base frame to which it is possible to connect a seat body with height adjustment elements, the seat body comprising a fixed back to which a movable and height-adjustable back is connected, a sill being further provided which can be detachably associated with the seat body and being provided with safety elements adapted to prevent coupling to the seat body when the movable back is in an incorrect position.

15 Claims, 20 Drawing Sheets

CHAIR, CONVERTIBLE INTO A BABY'S HIGHCHAIR

The present invention relates to a chair, convertible into a baby's highchair.

BACKGROUND OF THE INVENTION

As is known, several types of high chairs for babies are available on the market which allow the user to make a height adjustment and which are provided with a sill which is detachable according to the needs of use.

With the solutions of the known art, currently there are considerable difficulties in making the several connections and in particular it is not possible to have the safety characteristics that make it possible to always achieve a correct mounting of the sill and in any case of all the parts that make up the highchair.

SUMMARY OF THE INVENTION

The aim of the invention is to solve the aforementioned problems, by providing a chair, convertible into a baby's highchair, which offers the possibility of having a particularly versatile ensemble that allows the connection of the sill for the conversion into a highchair only if the coupling occurs in observance of the safety rules.

Within this aim, an object of the invention is to provide a convertible chair that is particularly versatile and capable of having different situations of use, thus being able to adapt to all contingent needs of the baby and also of the adults.

Another object of the present invention is to provide a convertible chair that, owing to its distinctive implementation characteristics, is capable of offering the widest guarantees of reliability and safety in use.

Another object of the present invention is to provide a chair, convertible into a baby's highchair, which, owing to its distinctive implementation characteristics, is capable of offering the widest guarantees of reliability and safety in use.

A further object of the present invention is to provide a chair, convertible into a baby's highchair, which can be easily implemented using elements and materials that are readily available on the market and which, moreover, is competitive from a merely economical viewpoint.

This aim and these and other objects, which will become better evident hereinafter, are achieved by a chair, convertible into a baby's highchair, according to the invention, comprising a base frame to which it is possible to connect a seat body with height adjustment means, characterized in that said seat body comprises a fixed back to which a movable and height-adjustable back is connected, a sill being further provided which can be associated detachably with said seat body and is provided with safety means adapted to prevent coupling to said seat body when said movable back is in an incorrect position.

BRIEF DESCRIPTION OF THE DRAWINGS

Further characteristics and advantages of the invention will become better apparent from the description of a preferred, but not exclusive, embodiment of a chair, convertible into a baby's highchair, illustrated by way of non-limiting example in the accompanying drawings wherein.

DESCRIPTION OF THE PREFERRED EMBODIMENTS

Figure 1:
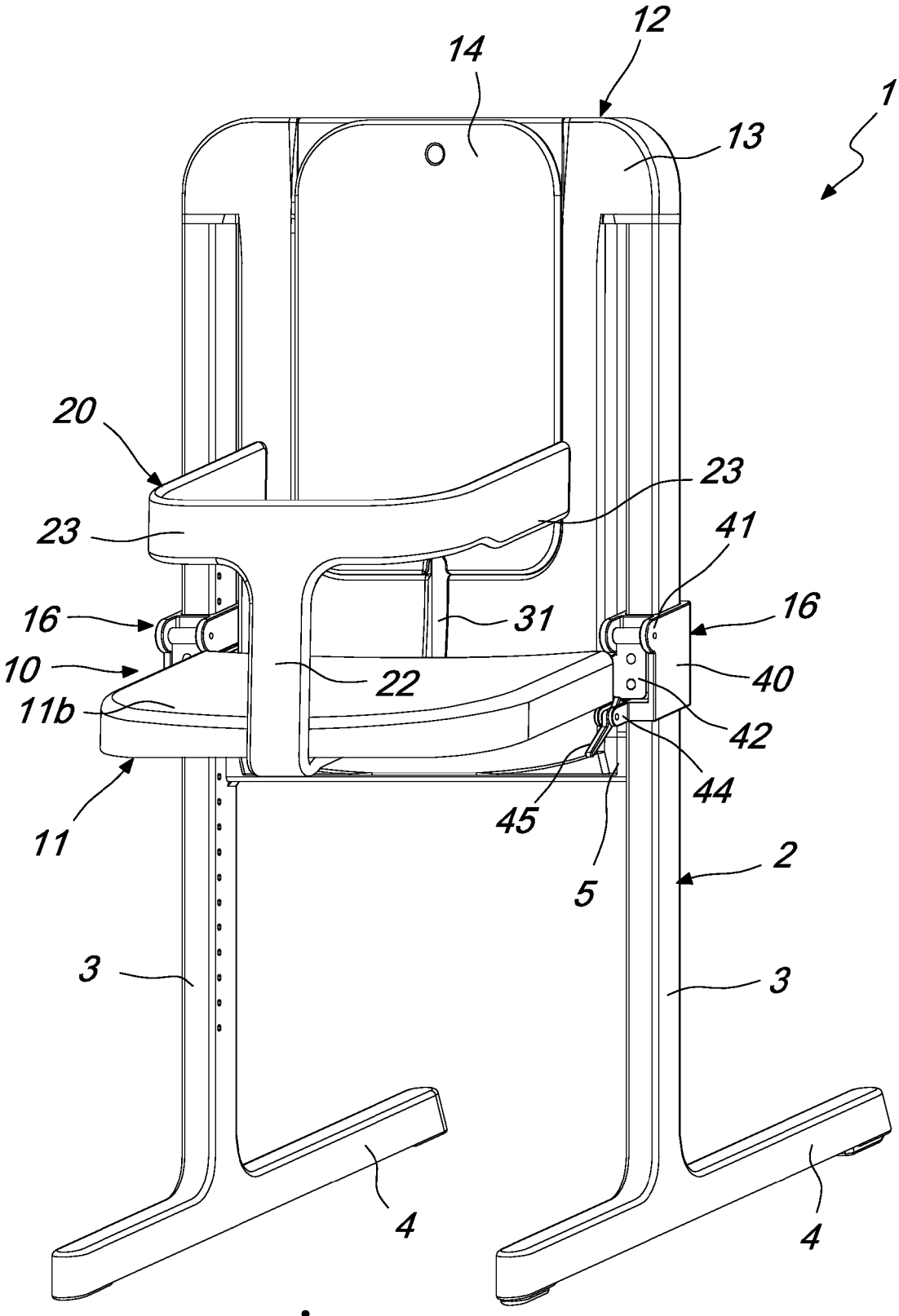
FIG. 1 is a perspective view of the chair with the sill applied.
Figure 2:
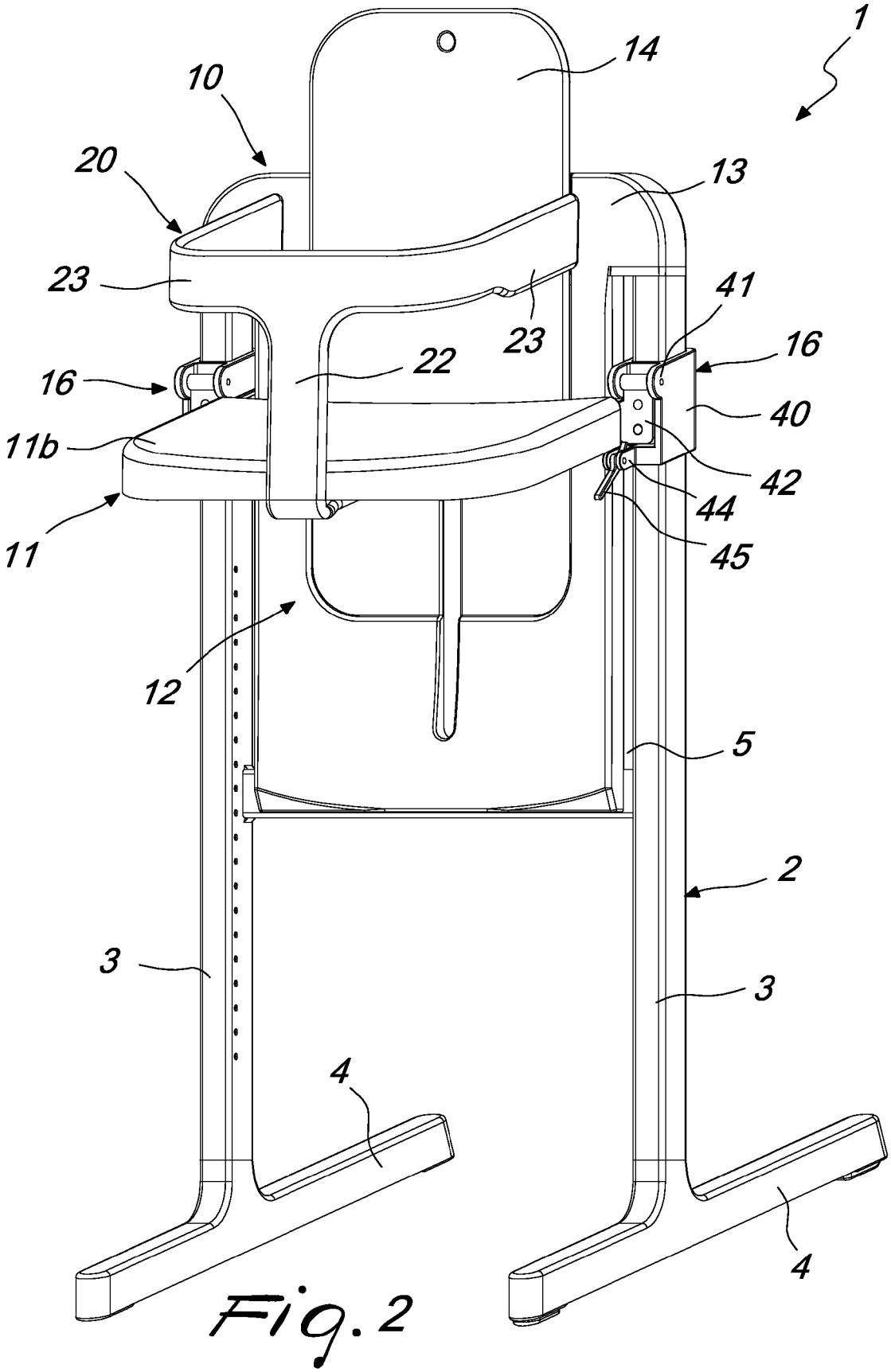
FIG. 2 is a perspective view of the chair with the seat body in the raised position and with the sill applied.
Figure 3:
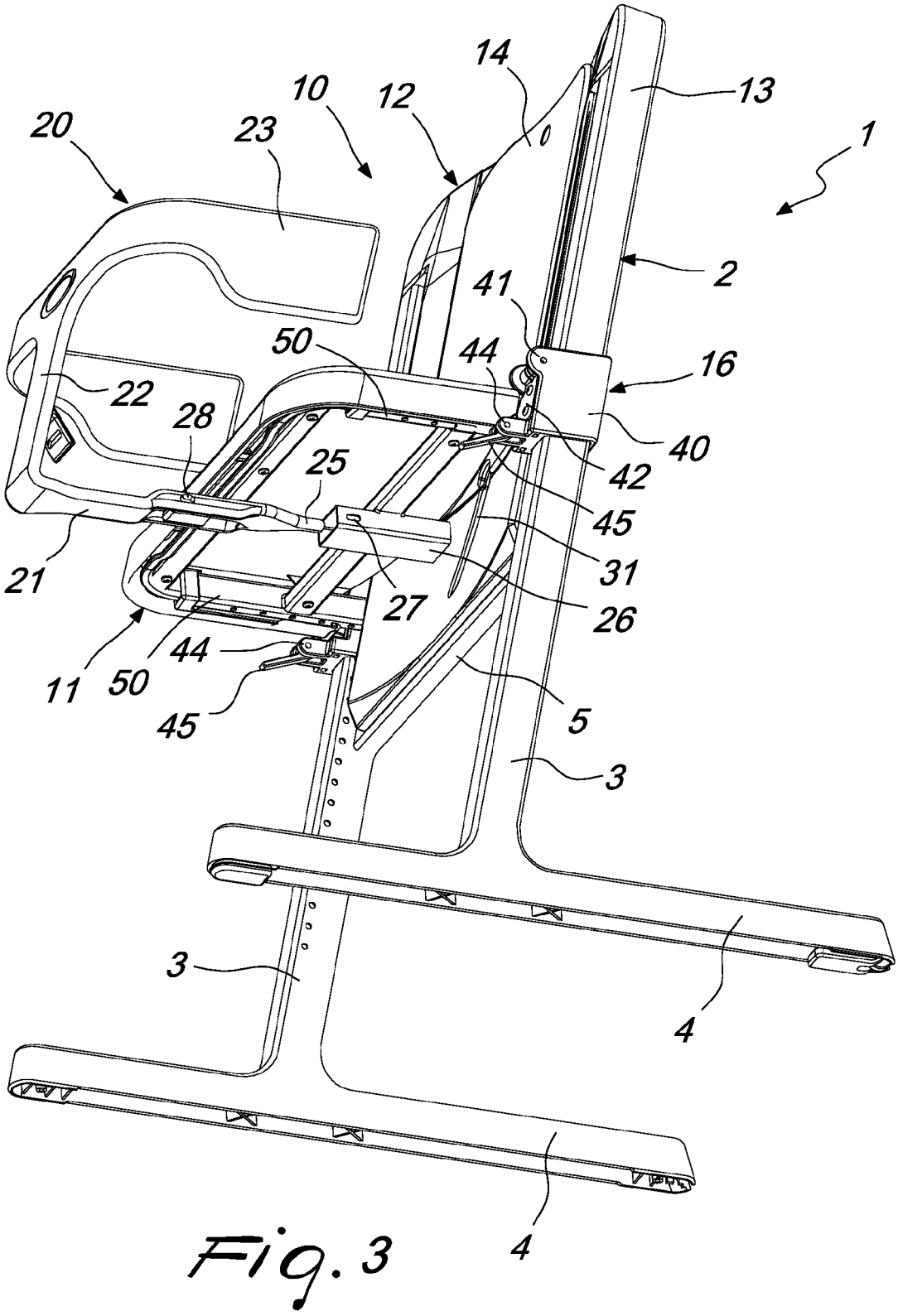
FIG. 3 is a perspective view from below of the chair with the sill exploded.
Figure 4:
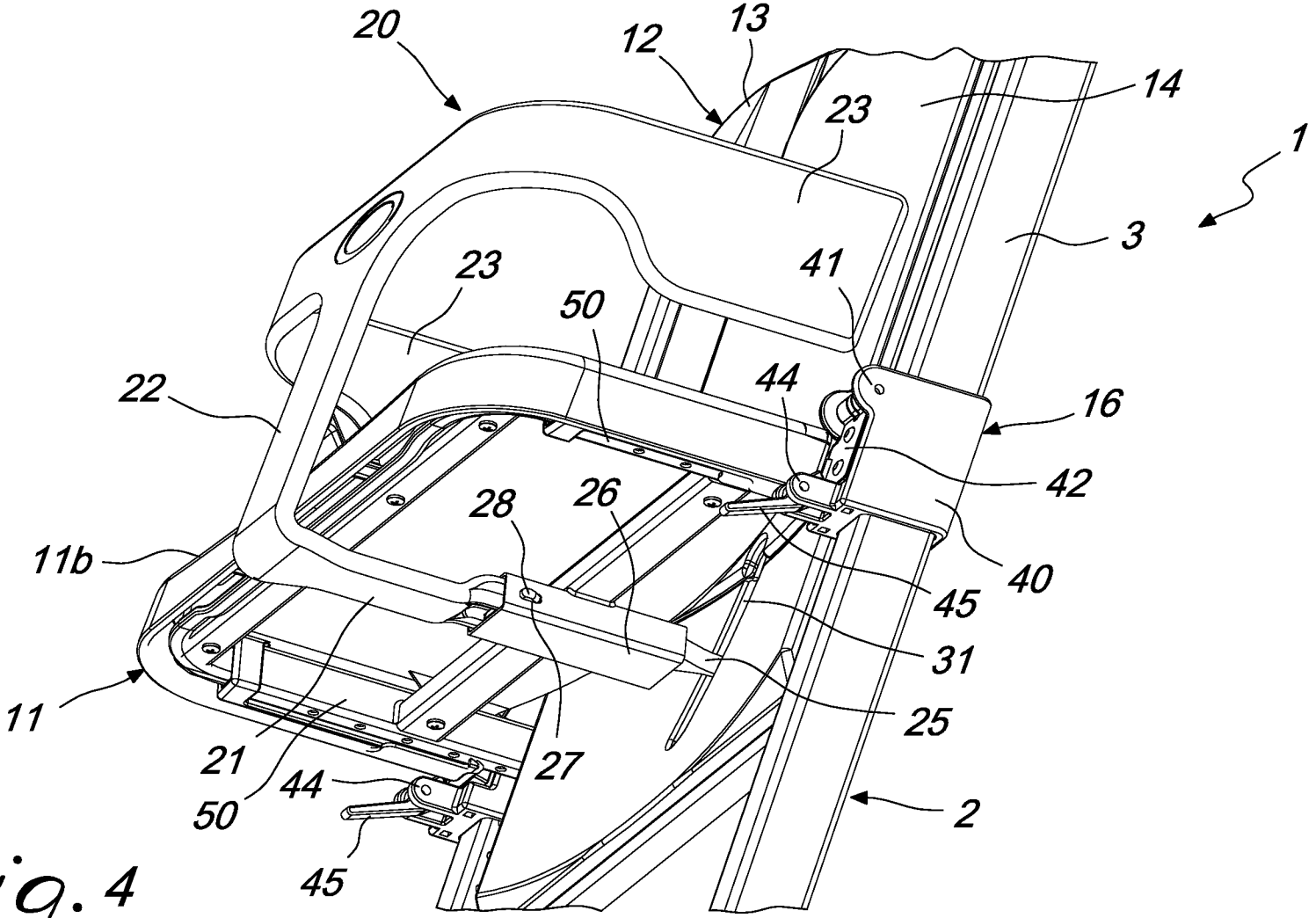
FIG. 4 is a perspective view from below of the connection of the sill.
Figure 5:
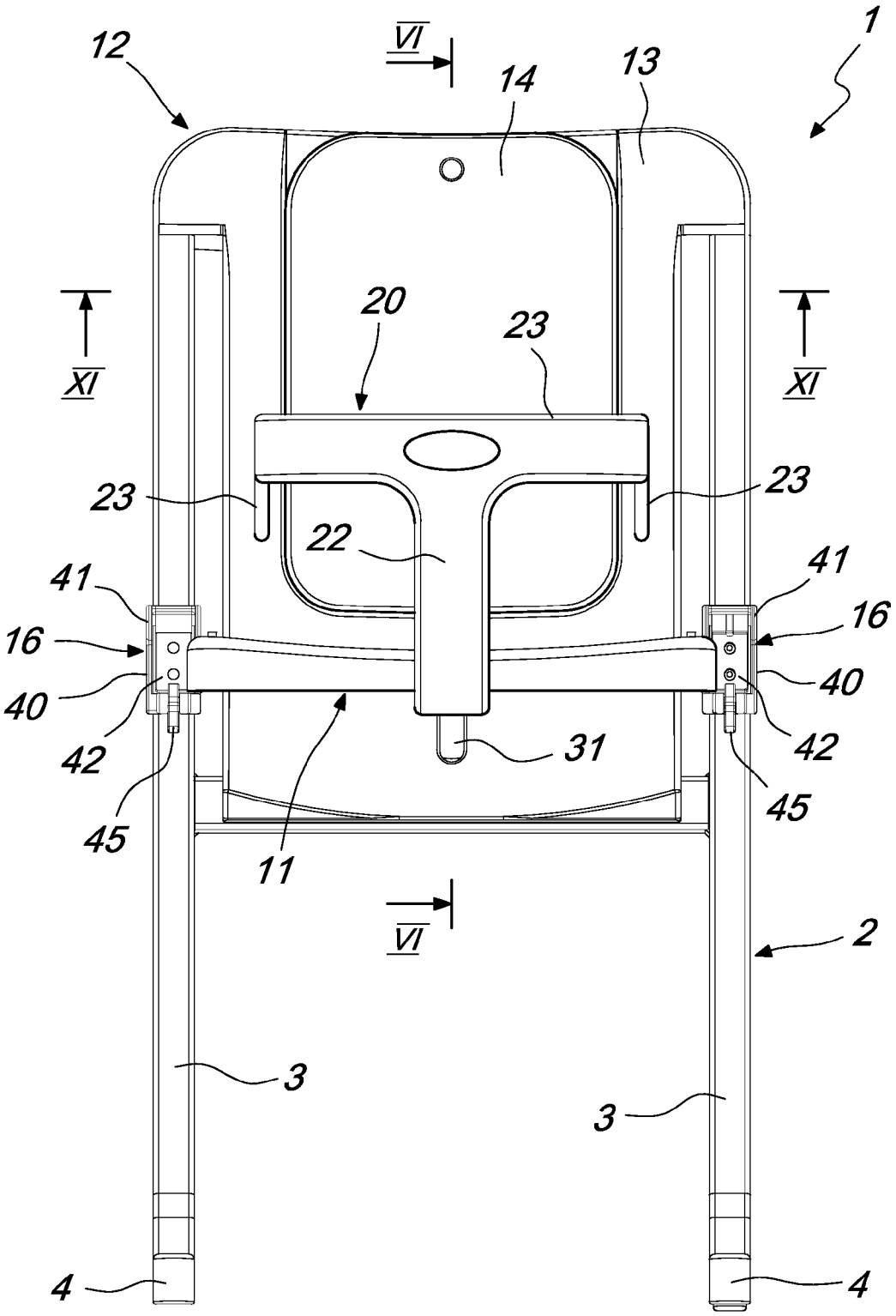
FIG. 5 is a front elevation view of the chair.

With reference to the figures, a chair, convertible into a baby's highchair, generally designated with the reference numeral 1, comprises a base frame 2 which is made with a pair of uprights 3 provided with an elongated support foot 4 and joined by an intermediate cross-piece 5.

The frame supports a seat body 10 that, in its upper portion, stably joins the uprights 3.

The seat body is provided with a seat 11 and with a back 12 that has a fixed back 13 and a movable back 14 that is height-adjustable.

The seat body 10 is connected to the uprights 3 by way of height adjustment means, generally designated with the reference numeral 16 which will be described in more detail hereinbelow.

Figure 6:
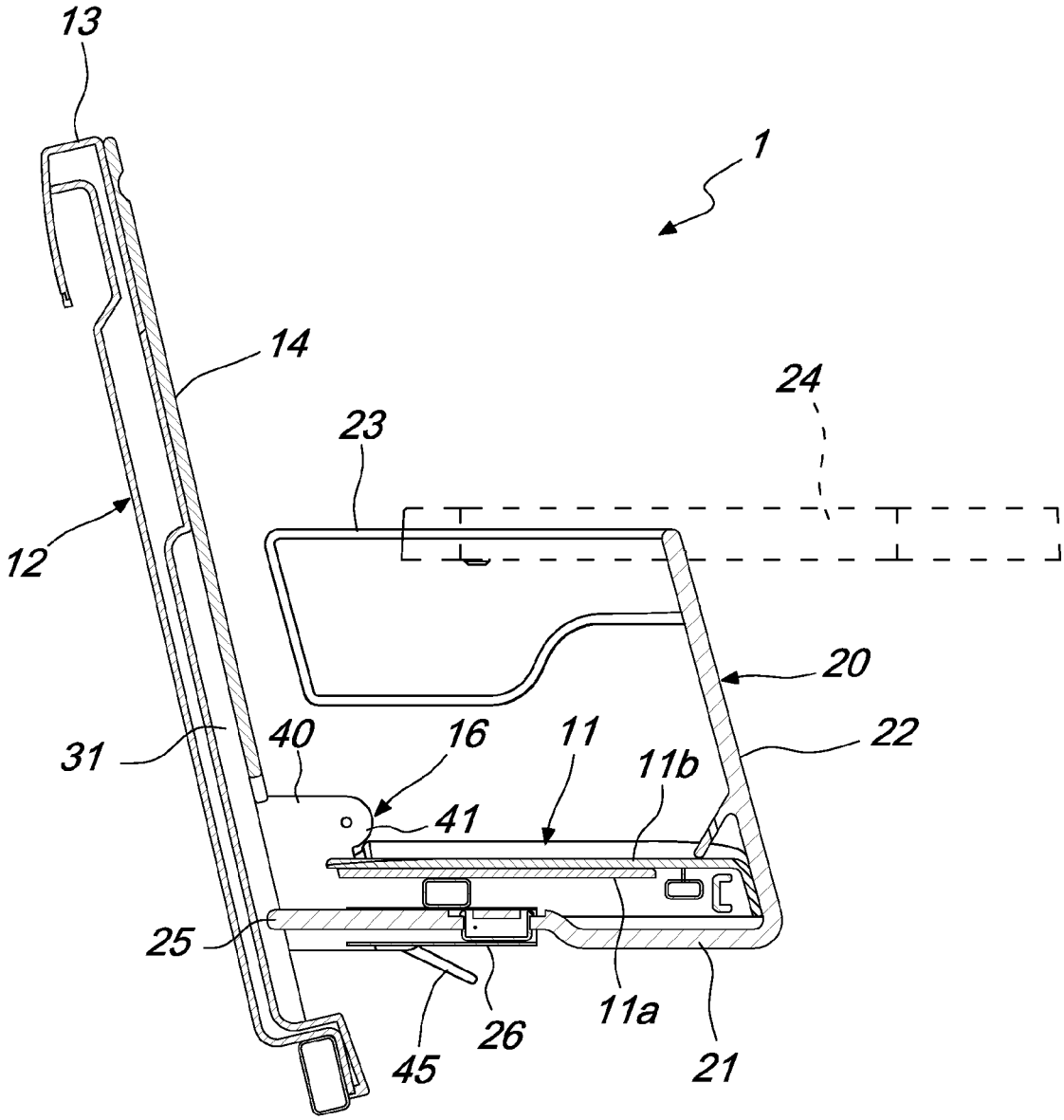
FIG. 6 is a sectional view taken along the line VI-VI in FIG. 5, showing the region for connection of the sill.

The seat 11 can be detachably coupled to a sill 20 that has a lower engagement portion 21 that connects to a central element 22 that supports an upper rim 23 which in practice has the function of holding the baby; the rim 23 can be connected to a surface 24, shown with dotted lines in FIG. 6.

The sill 20 is provided with safety means in order to prevent coupling to the seat body when the movable back is in an incorrect position.

The safety means include a pushrod or point 25 that is inserted in a sleeve 26 that is jointly connected to the lower face of the seat 11 and is provided with insertion openings 27 for the insertion of pins 28 which are associated with a divarication spring 29 accommodated in the lower engagement portion 21.

Figure 9:
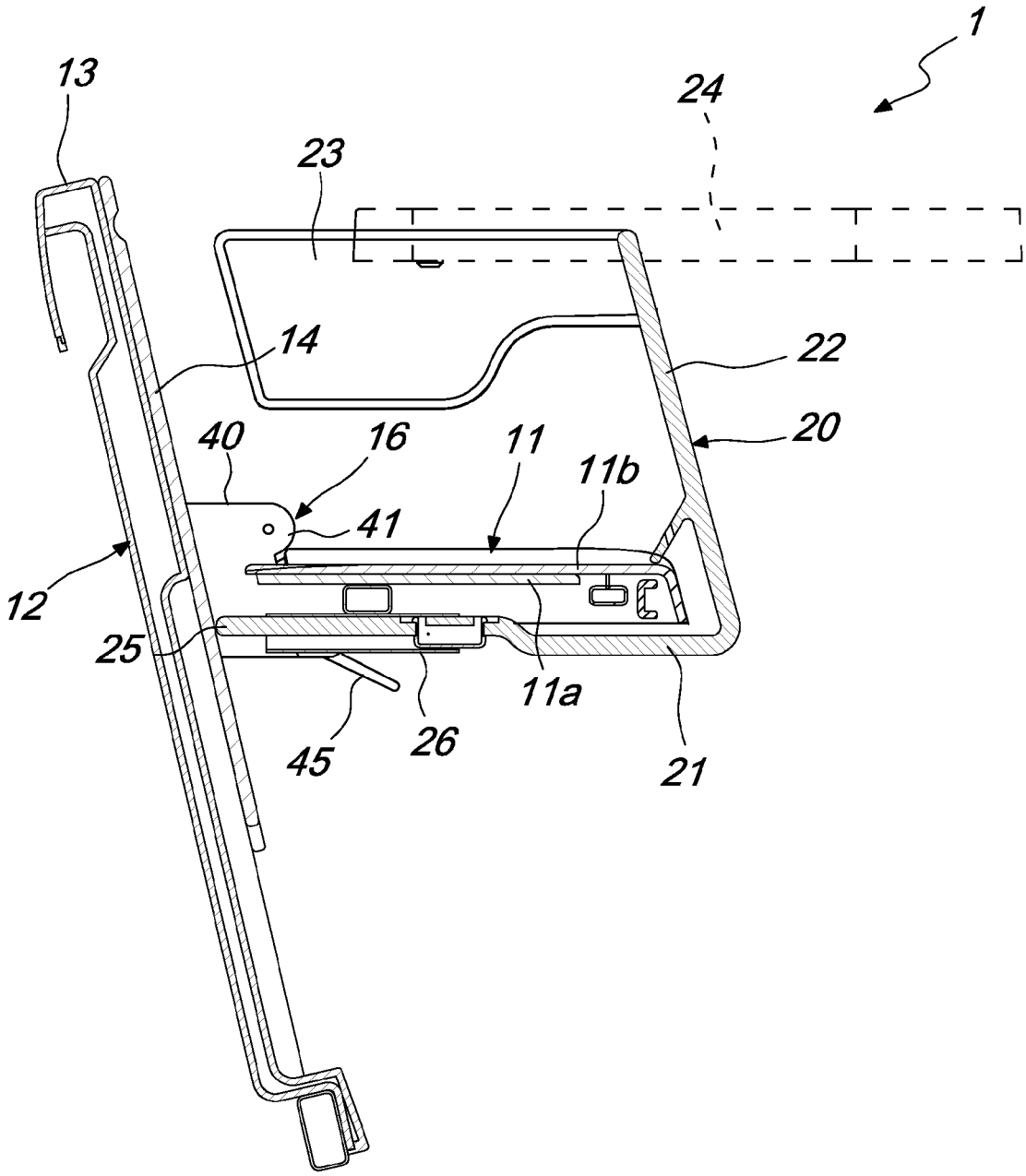
FIG. 9 is a sectional view of the seat body with the movable back in an incorrect position, showing the impediment to connecting the sill.
Figure 10:
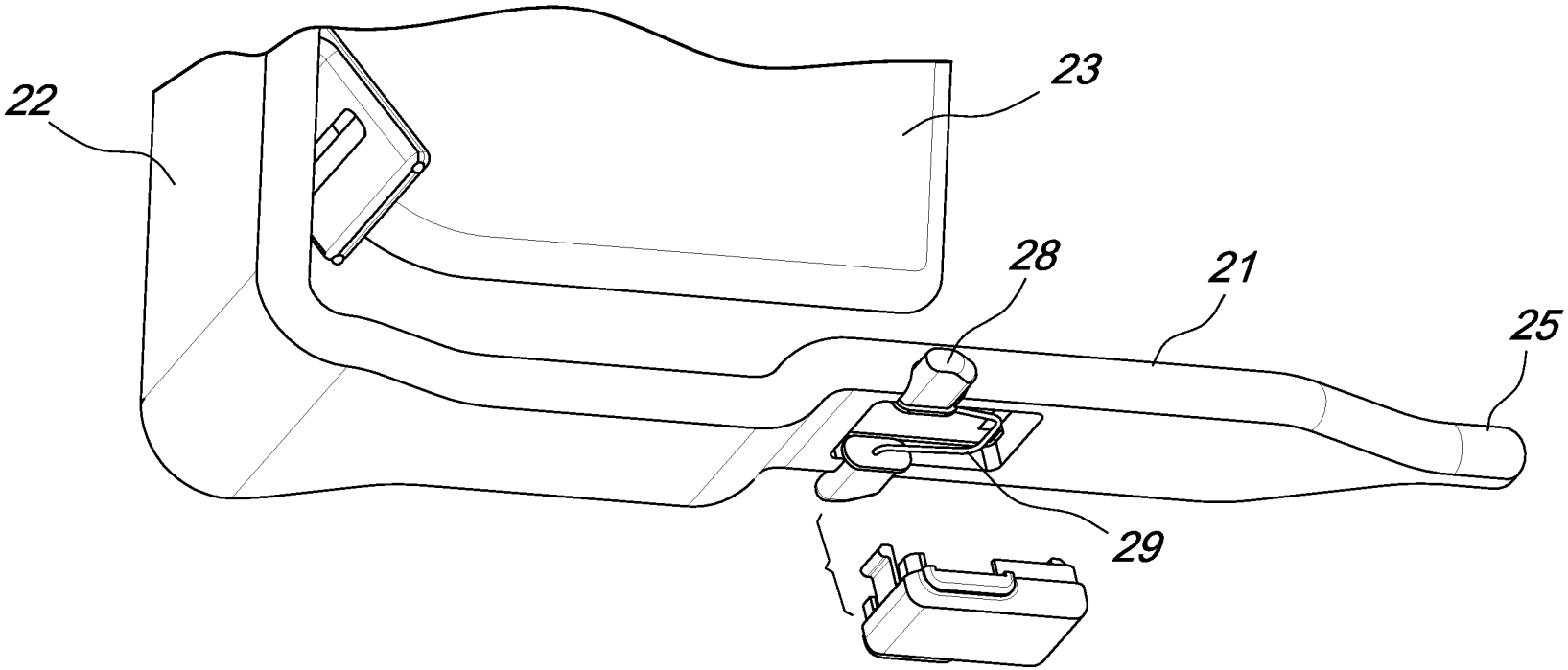
FIG. 10 is a perspective view from below of a detail of the connection of the sill.
Figure 12:
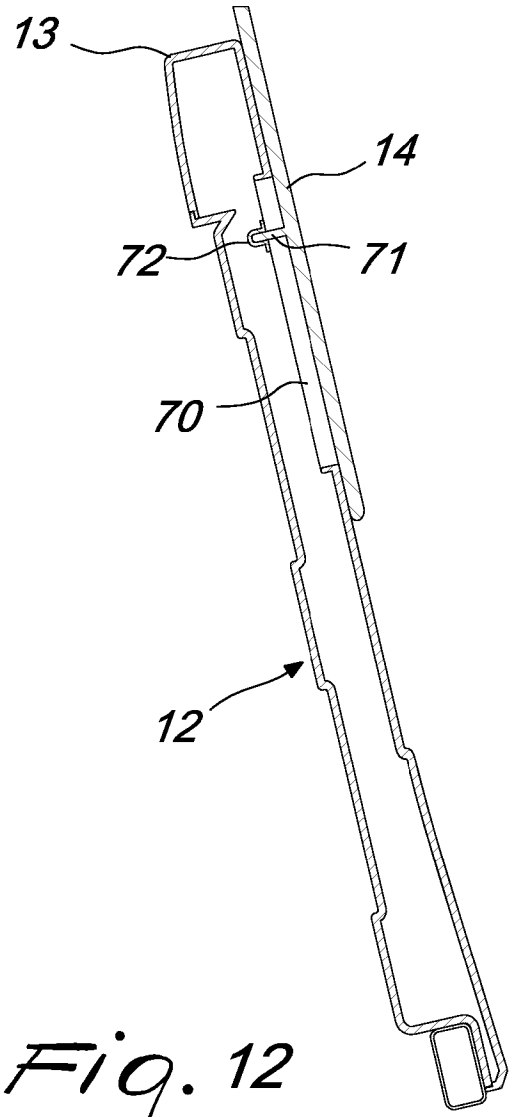
FIG. 12 is a sectional view taken along the line XII-XII in FIG. 11.
Figure 11:
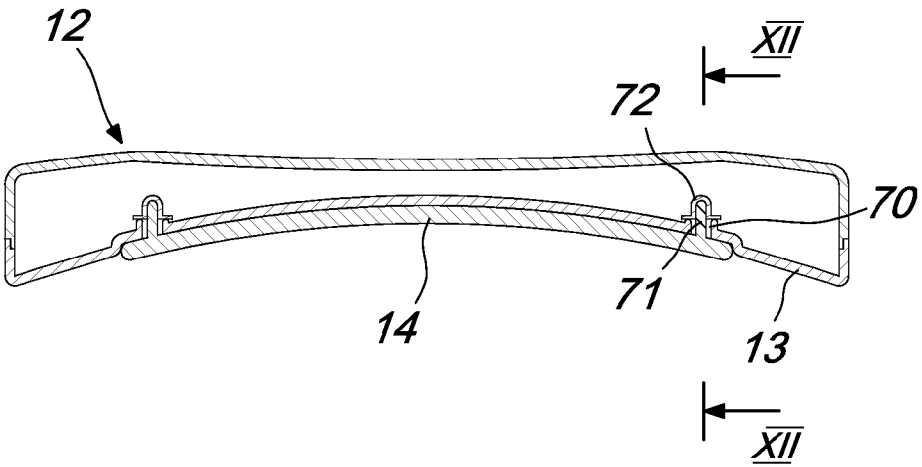
FIG. 11 is a sectional view taken along the line XI-XIV in FIG. 5.
Figure 13:
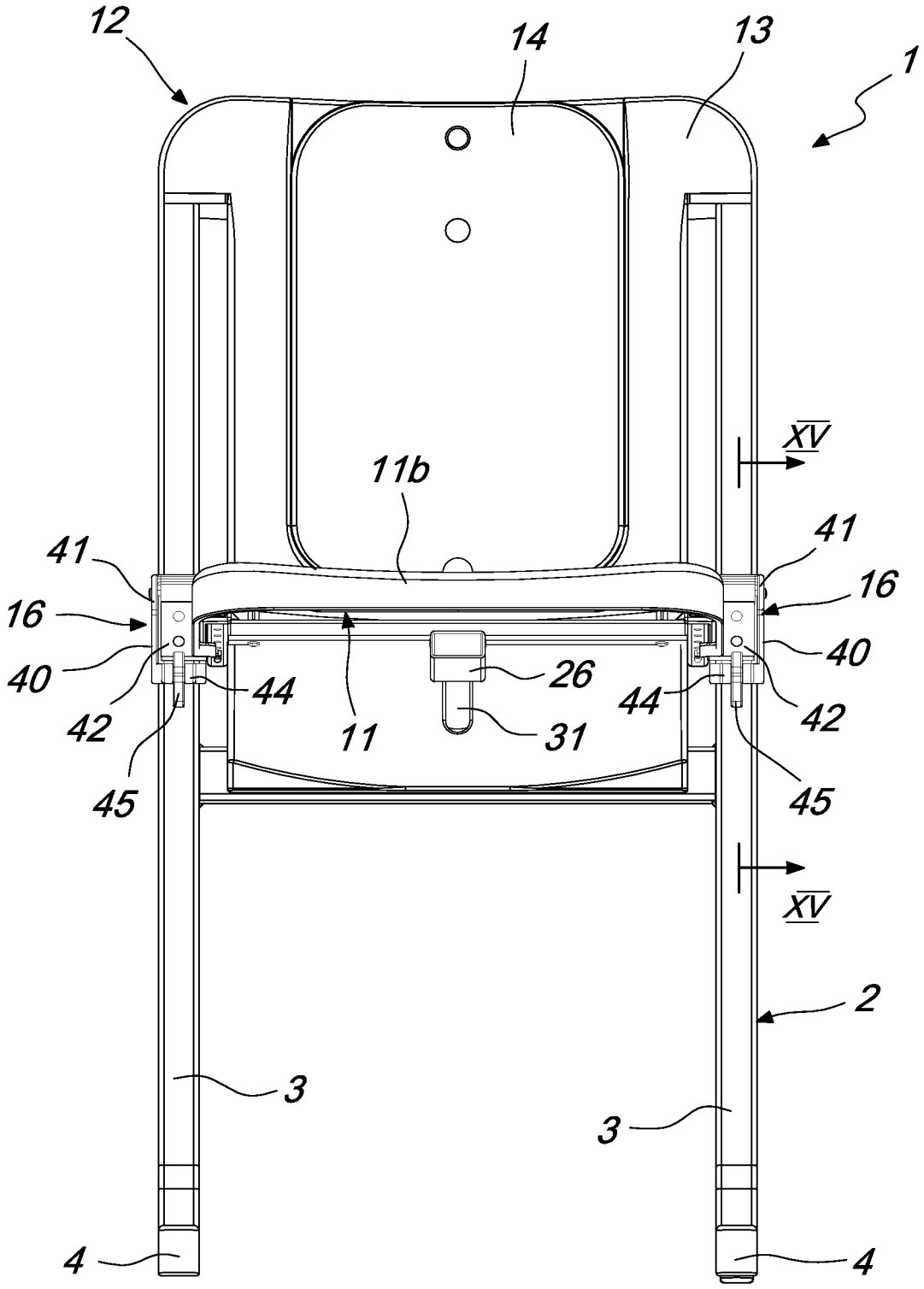
FIG. 13 is a front elevation view of the chair without the sill applied.
Figure 14:
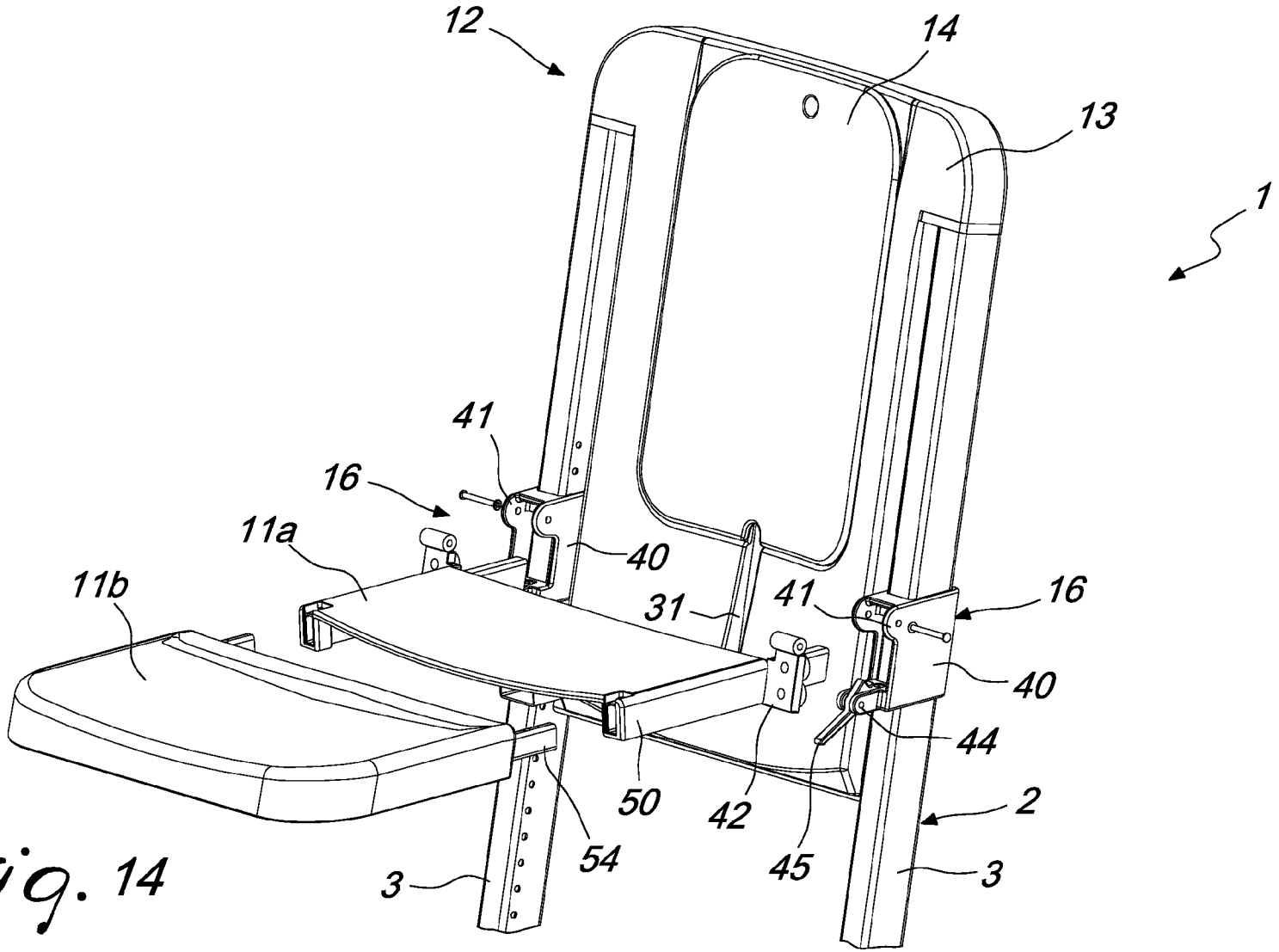
FIG. 14 is a perspective view of the seat body with the seat exploded.

The elongated element has a point 25 that is inserted in a vertical slot 31 that is provided on the fixed back 13; the upper portion of the slot 31 remains covered by the movable back 14, and hence if it is desired to insert the sill with the seat body 10 in the raised position without having adequately raised the movable back 14, as shown in FIG. 9, the point 25 cannot be inserted in the slot 31 and consequently it is not possible to achieve the connection (FIG. 9).

Figure 7:
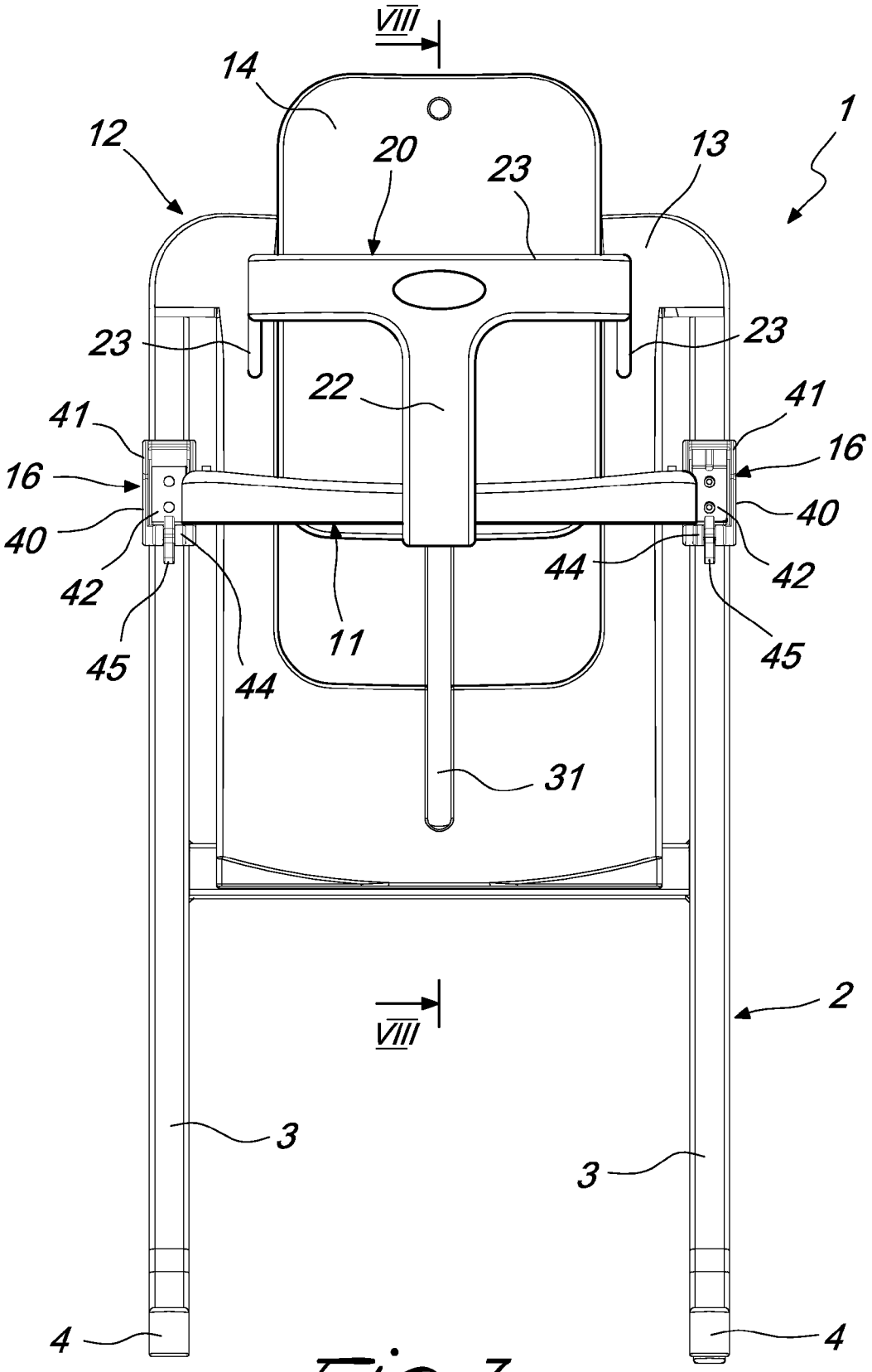
FIG. 7 is a front elevation view showing the chair with the seat body in the raised position.
Figure 8:
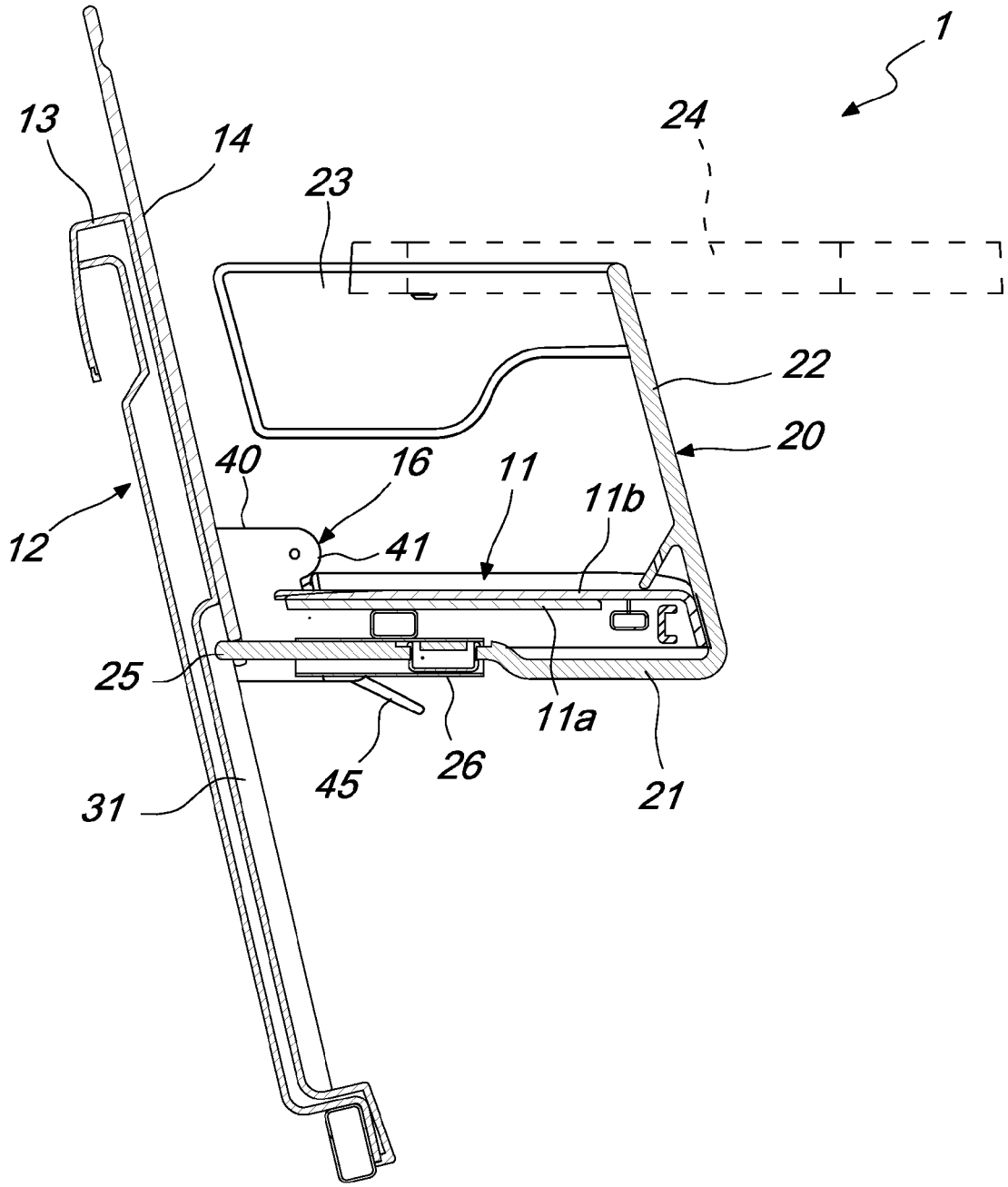
FIG. 8 is a sectional view taken along the line VIII-VIII in FIG. 7.

In order to achieve the fixing connection the movable back 14 must be made to perform a translational motion upwardly, as shown in FIGS. 7 and 8, and it is possible to achieve the coupling of the sill since the movable back 14 is in the correct position.

In order to execute the height adjustment of the seat body 10 height adjustment means are provided that are implemented with vertical sleeves 40, which define lugs 41 to which a locking plate 42 is pivoted which is jointly connected to the inner portion 11*a* of the seat 11.

Braking elements 43 are provided positioned on the plate 42, on the face directed toward the uprights.

The sleeve 40 has lower lugs 44 in which is pivoted a release lever 45 with a cam-shaped end 46 that operates on the end of the plate 42 in order to distance it from the upright against which it is normally positioned by the weight of the seat proper, and it is locked by way of the resting of the weight of a person or sitting, thus increasing the locking effect.

Figure 15:
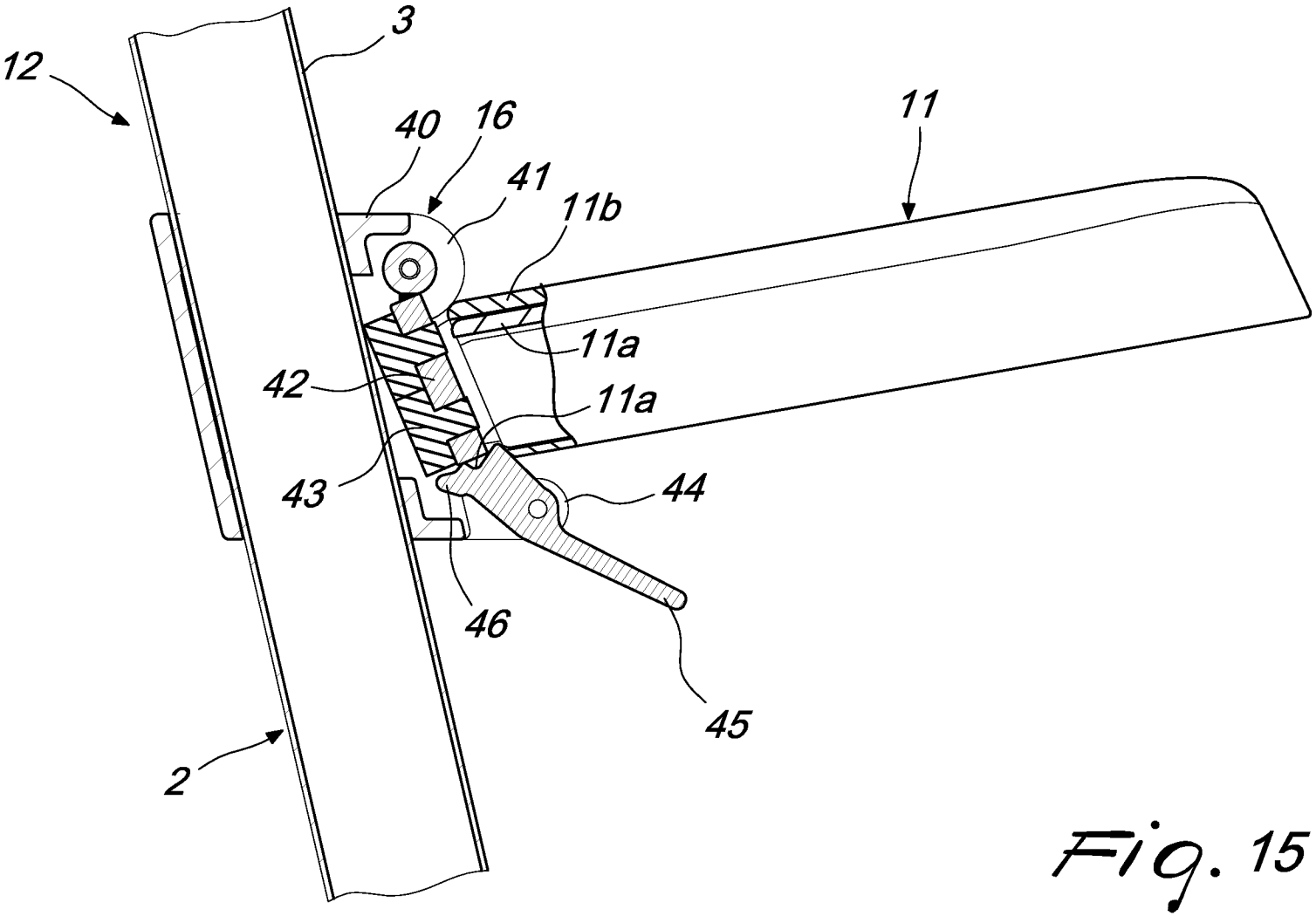
FIG. 15 is a sectional view taken along the line XV-XV in FIG. 13.
Figure 16:
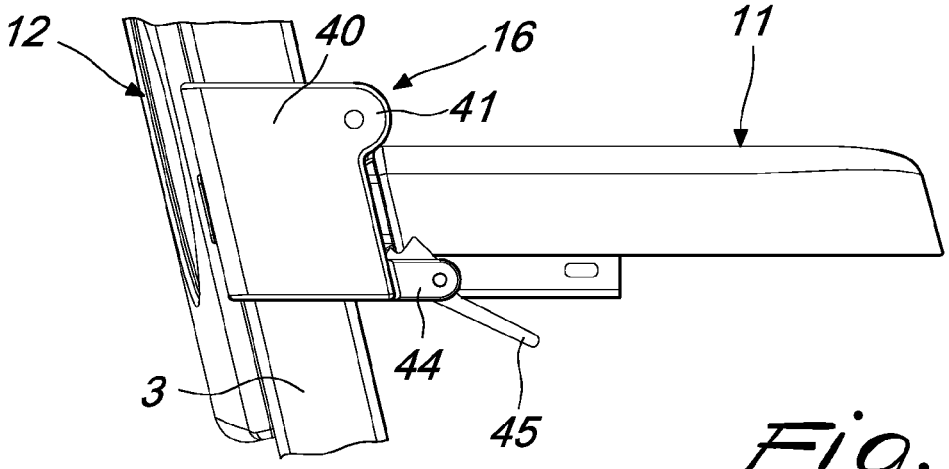
FIGS. 16, 17 and 18 are views of the different positions of the seat in order to execute the height adjustment of the seat body positioning.
Figure 17:
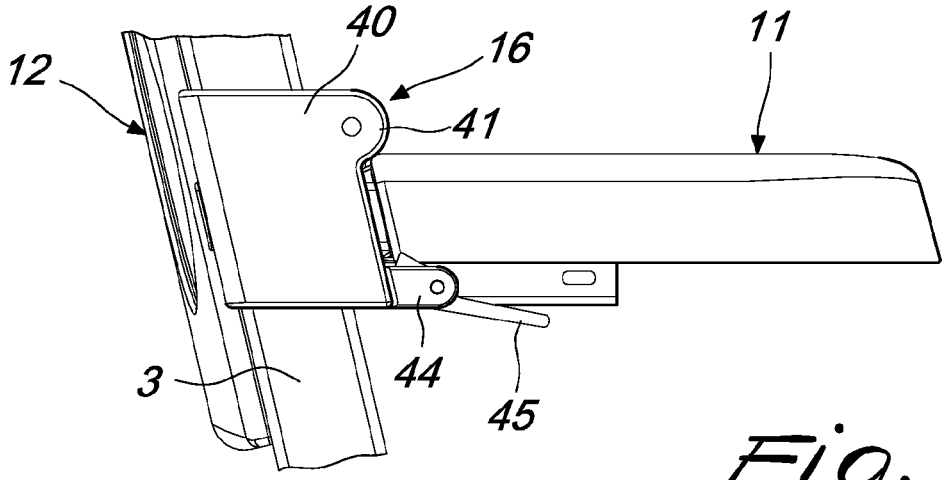
Figure 18:
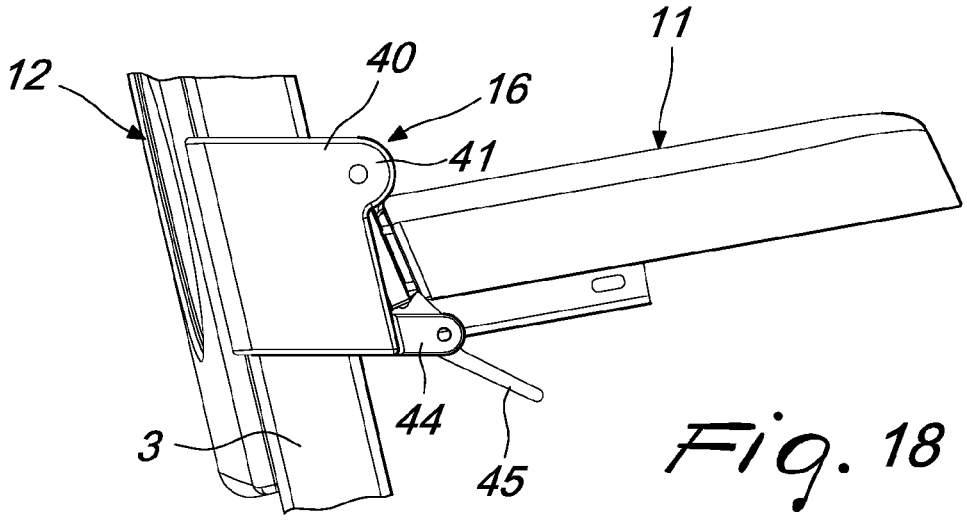
Figure 19:
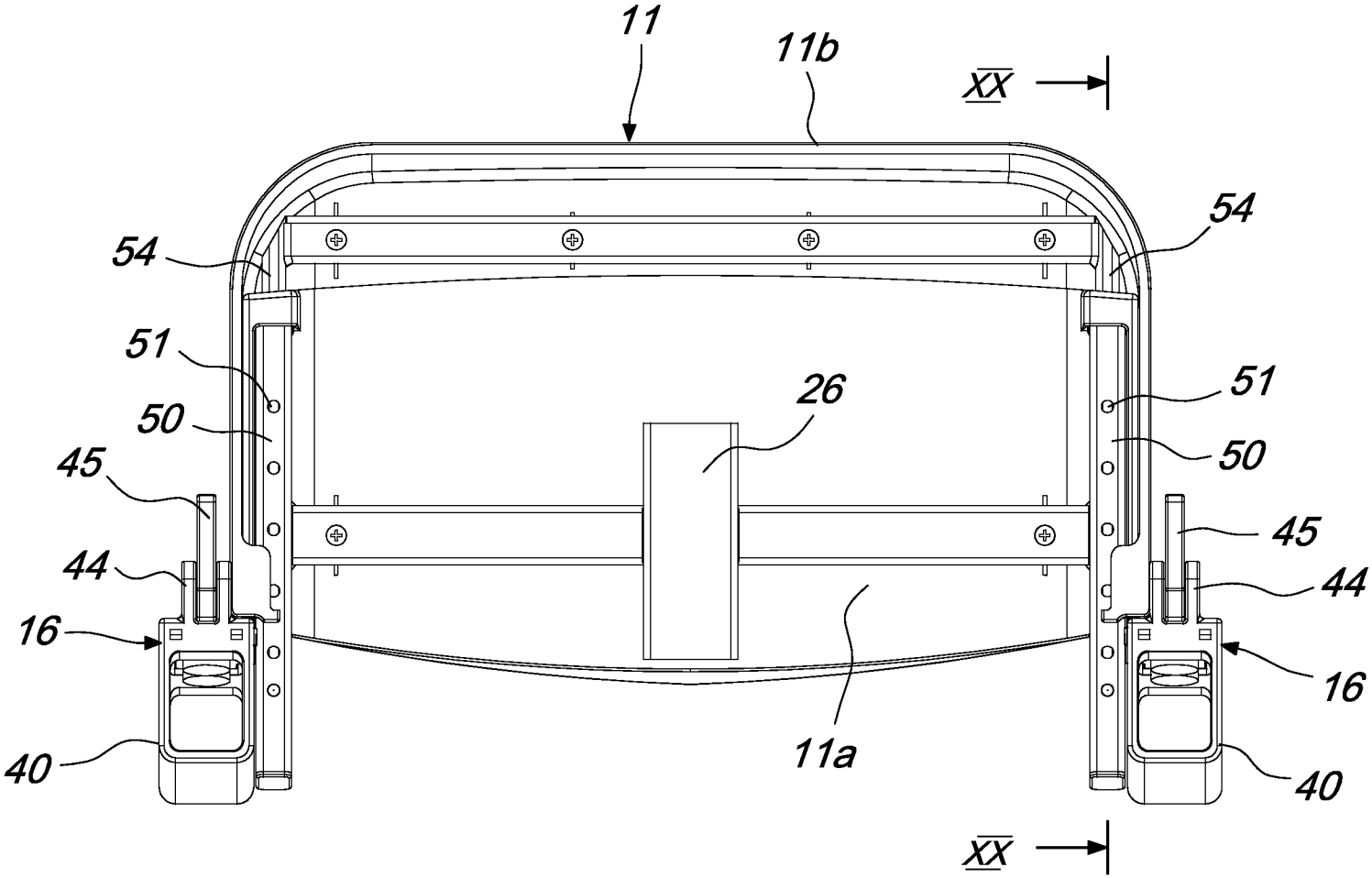
FIG. 19 is a view of the seat seen from below.
Figure 20:
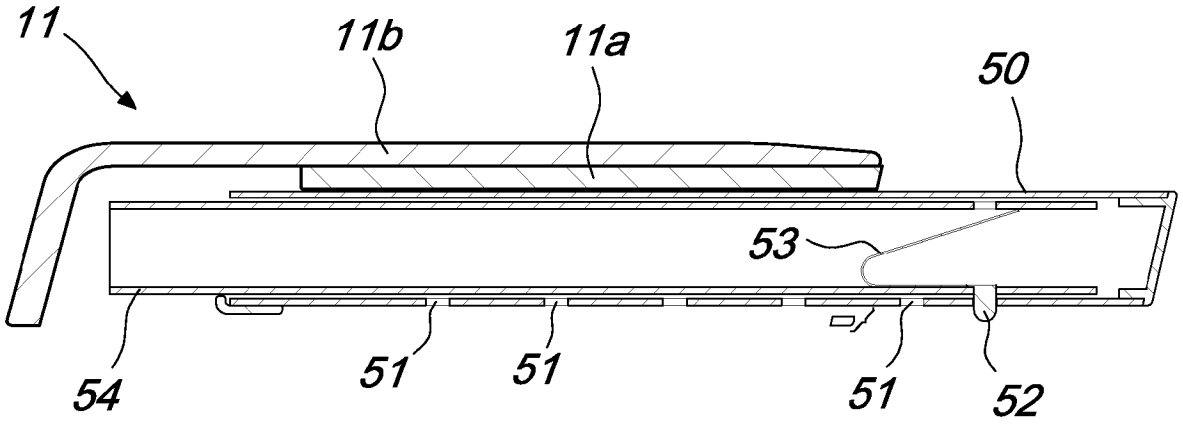
FIGS. 20 and 21 are sectional views taken along the line XX-XX in FIG. 19 with two different positions of the elements that make up the seat.
Figure 21:
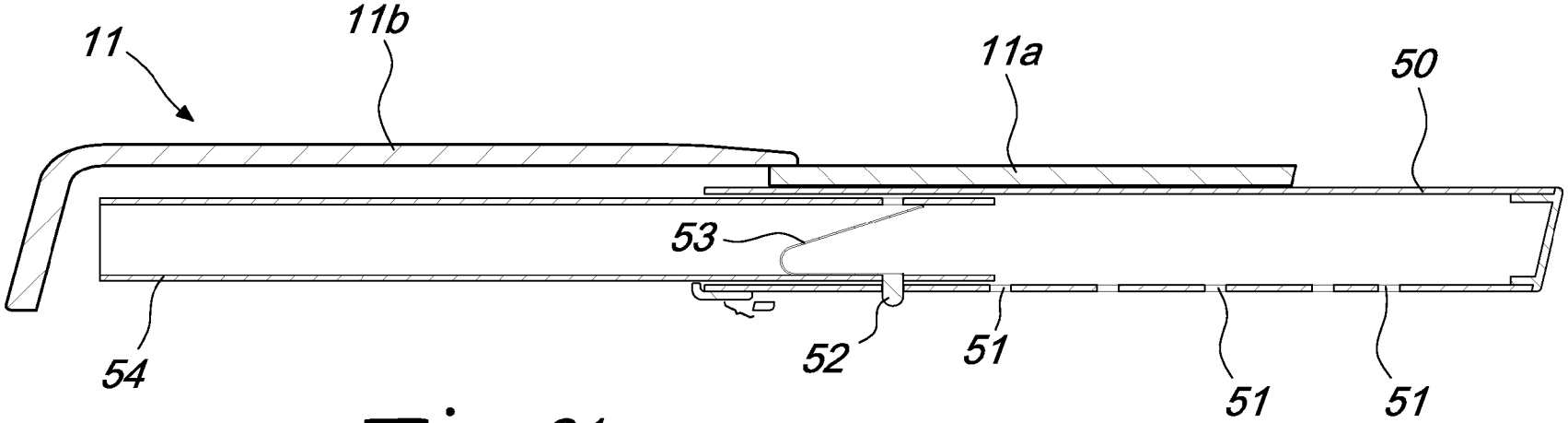
Figure 22:
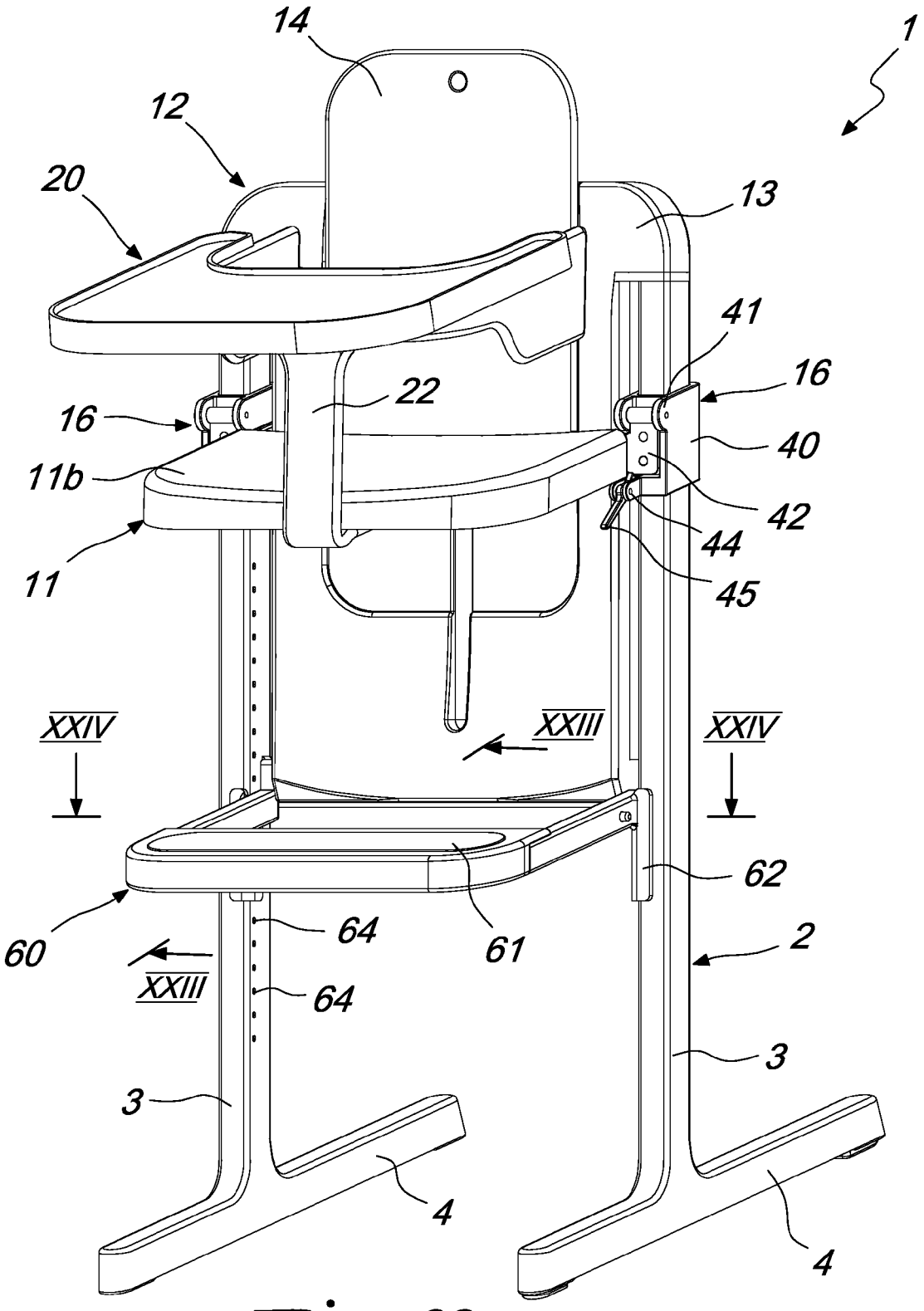
FIG. 22 is a perspective view of a highchair with the footrest applied.
Figure 23:
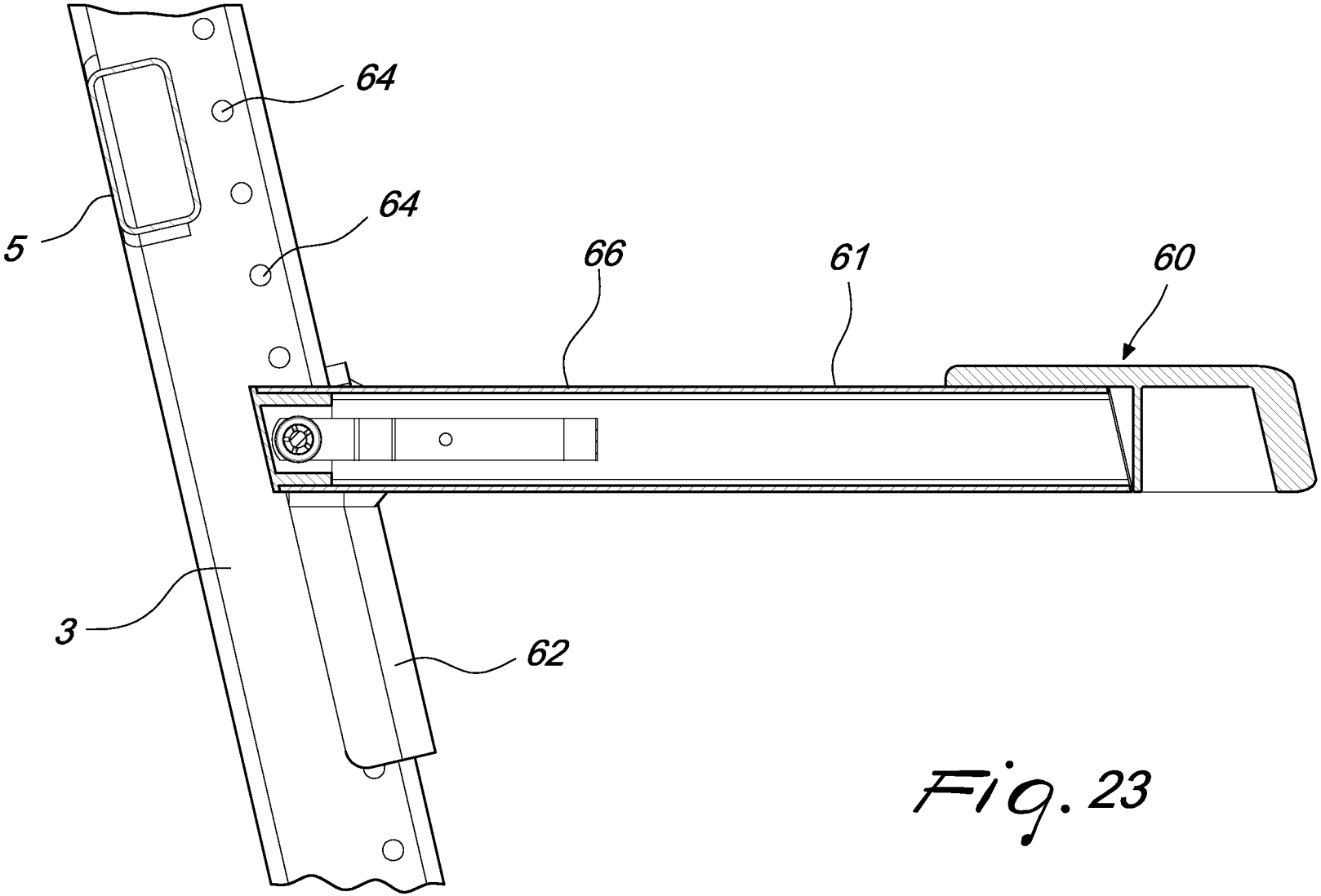
FIG. 23 is a sectional view taken along the line XXIII-XXIII in FIG. 22.
Figure 24:
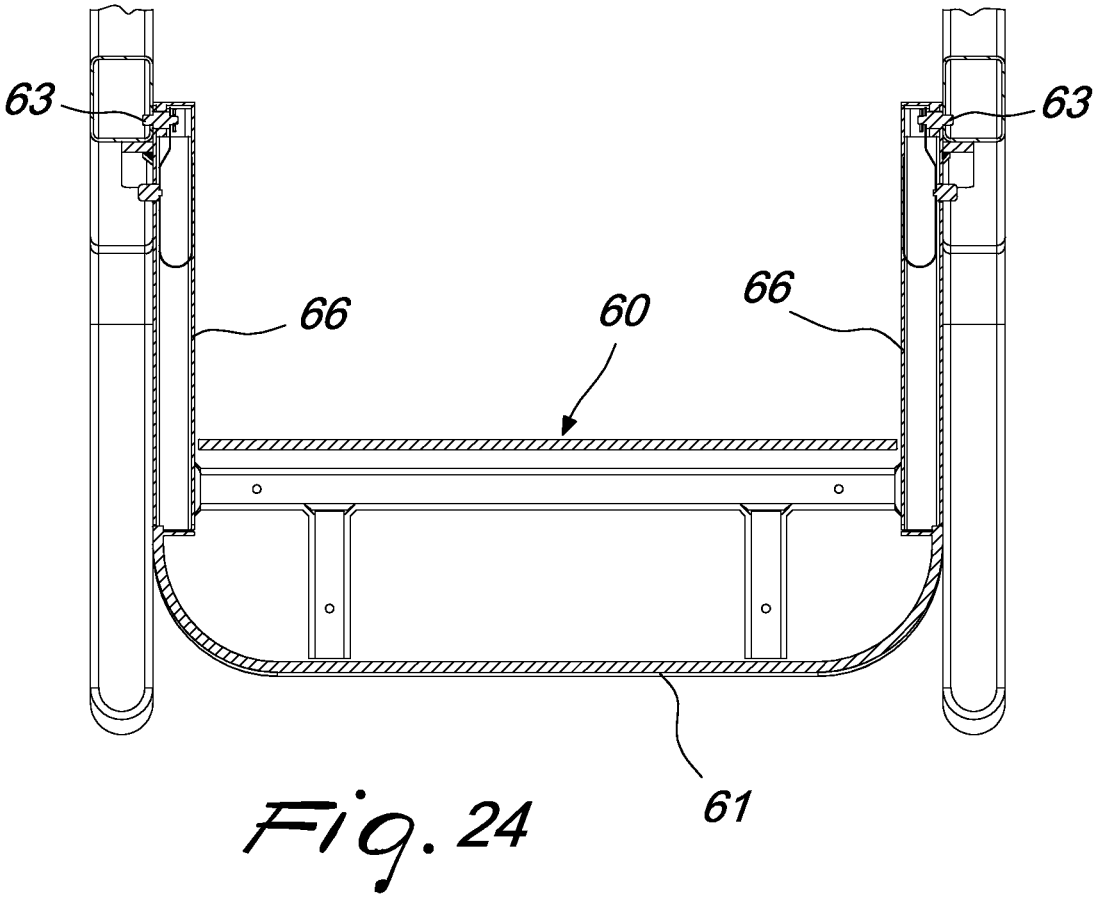
FIG. 24 is a sectional view taken along the line XXIV-XXIV in FIG. 22.
Figure 25:
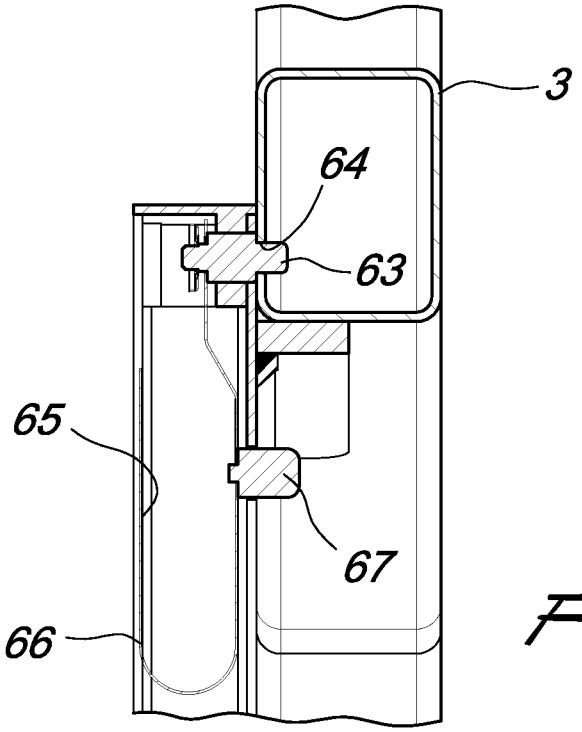
FIG. 25 is an enlarged-scale, vertical sectional view of the means of connecting the footrest.

By acting on the release lever 45 the plate 42 is distanced, as shown in FIGS. 15 and 18, giving the possibility to freely slide the seat body 10 in order to obtain the desired height positioning.

The seat 11 has an inner portion 11*a* above which there is an outer portion 11*b* that is slideable in order to vary its useful dimensions, as better shown in FIGS. 14 and 19, 20 and 21.

In particular, connected to the inner portion 11*a* of the seat 11 is a tubular guiding element 50 with positioning holes 51 in which can be inserted a locking pin 52 that is pushed by an interlocking lamina 53 that is accommodated in an internal tubular element 54 which is associated with the outer portion 11*b* of the seat.

This makes it possible to achieve, by sliding, an enlargement of the seating surface, thus obtaining the locking in the desired position.

The frame 2 can be connected to a footrest 60 which has a resting surface 61 that is fixed to L-shaped angular brackets 62 that engage with the uprights 3 and which achieve the locking by means of a locking pin 63 which is inserted in positioning holes 64 which are provided on the uprights 3.

The locking pin 63 is associated with the end of a U-shaped lamina 65 which is accommodated in the lateral crossmember 66 that supports the footrest and can be actuated by means of an actuation button 67 that allows the pin 63 to be disengaged from the holes 64 in order to achieve the positioning of the footrest at the desired height, then releasing the button with the insertion of the locking pin at the desired height.

To the foregoing it should be added that for the height positioning of the movable back 14, on the fixed back 13 of the back there are vertical slots with a rim, designated with 70, into which can be inserted protrusions 71 that protrude from the movable back, for which clamp caps 72 are positioned which hold the movable back against the fixed portion 13, and hence a stroke limit is provided for the sliding of the back, which thus cannot accidentally slip out.

From the foregoing explanation it can be seen how the invention achieves the intended aim and objects, and in particular attention is drawn to the fact that a baby's highchair is provided which derives from a chair that can be easily converted, simply by applying a sill which can be correctly inserted only if the movable back is in the correct position.

Moreover the solution described offers the possibility of easily varying the seating surface by sliding the external seat with respect to the internal seat, which considerably extends the useful dimensions, thus making the chair usable for an adult as well.

Moreover it is possible to apply a footrest at the desired height with extremely quick and simple maneuvers.

The invention, thus conceived, is susceptible of numerous modifications and variations, all of which are within the scope of the appended claims.

Moreover, all the details may be replaced by other, technically equivalent details.

In practice the materials employable, as well as the dimensions and the contingent shapes, may be any according to requirements.

The disclosures in Italian Patent Application No. MI2010A000640 from which this application claims priority are incorporated herein by reference.

What is claimed is:

1. A chair, convertible into a baby's highchair, comprising:

a base frame;

a seat body connected to said base frame, wherein said seat body comprises a fixed back, a movable and height-adjustable back connected to said fixed back, and a seat having a lower face; and a sill detachably connected with said seat body, said sill comprising safety means adapted to prevent coupling of said sill to said seat body when said movable back is in a first predetermined position, wherein said sill comprises:

a lower engagement portion;

a central element connected to said lower engagement portion; and an upper rim supported by said central element for containing a child;

wherein said safety means comprise:

a point arranged at an end of said lower engagement portion;

a sleeve into which said point is insertable, said sleeve being jointly connected to said lower face of said seat, said sleeve comprising an insertion opening;

a pin insertable into said insertion opening; and a divarication spring, which is associated with the pin and accommodated in said lower engagement element.

2. The chair according to claim 1, further comprising a vertical slot that is defined on the fixed back of said back, said vertical slot being coverable at least partially by said movable back, said point being insertable in said vertical slot when said movable and height-adjustable back is in a second predetermined position.

3. The seat according to claim 1, wherein the seat body further comprises a height adjustment means, said height adjusting means comprising vertical sleeves that define pivoting lugs for a locking plate, said locking plate being jointly connected to said seat, said locking plate comprising braking elements on a face directed toward uprights of said base frame.

4. The chair according to claim 3, wherein the height adjustment means further comprises lower lugs provided on said vertical sleeves for pivoting a release lever having a cam-shaped end, wherein said cam-shaped end is adapted to engage an end of said locking plate for spacing said locking plate from said uprights, such that said vertical sleeves can slide on said uprights.

5. The chair according to claim 1, wherein said seat comprises an inner portion and an outer portion telescopically connected to said inner portion, and wherein said inner portion comprises:

tubular guiding elements having positioning holes;

a first locking pin insertable into said positioning holes of said tubular guiding elements;

an interlocking lamina for pushing said first locking pin; and an internal tubular element associated with the outer portion of said seat for accommodating said interlocking lamina.

6. The chair according to claim 3, further comprising a footrest detachably connected with said uprights of said base frame, wherein the footrest comprises:

a supporting surface,

L-shaped angular brackets to which said supporting surface is fixed, said angular brackets being engageable to said uprights, a second locking pin insertable into positioning holes of said uprights, a U-shaped lamina, and end of said U-shaped lamina being associated with said second locking pin, and a lateral crossmember for accommodating said U-shaped lamina, wherein said lateral cross member supports said footrest and can be actuated by means of an actuation button accessible from the outside.

7. The chair according to claim 1, further comprising protrusions for connecting said movable and height-adjustable back to said fixed back, wherein said protrusions protrude from said movable and height-adjustable back and wherein said fixed back defines additional vertical slots having a rim, such that said protrusions can engage in said additional vertical slots.

8. A chair, convertible into a baby's highchair, comprising:

a base frame;

a seat body connected to said base frame, wherein said seat body comprises a fixed back, a movable and height-adjustable back connected to said fixed back, and a seat having a lower face;

a sill detachably connected with said seat body, said sill comprising safety means adapted to prevent coupling of said sill to said seat body when said movable back is in a first predetermined position; and protrusions for connecting said movable and height-adjustable back to said fixed back, wherein said protrusions protrude from said movable and height-adjustable back, wherein said fixed back defines vertical slots having a rim, such that said protrusions can engage in said vertical slots wherein the fixed back does not move relative to the base frame.

9. The chair according to claim 8, wherein said sill comprises:

a lower engagement portion;

a central element connected to said lower engagement portion; and an upper rim supported by said central element for containing a child.

10. The chair according to claim 9, wherein said safety means comprise:

a point arranged at an end of said lower engagement portion;

a sleeve into which said point is insertable, said sleeve being jointly connected to said lower face of said seat, said sleeve comprising an insertion opening;

a pin insertable into said insertion opening; and a divarication spring, which is associated with the pin and accommodated in said lower engagement element.

11. The chair according to claim 10, further comprising a second vertical slot that is defined on the fixed back of said back, said second vertical slot being coverable at least partially by said movable back, said point being insertable in said second vertical slot when said movable and height-adjustable back is in a second predetermined position.

12. The seat according to claim 8, wherein the seat body further comprises a height adjustment means, said height adjusting means comprising vertical sleeves that define pivoting lugs for a locking plate, said locking plate being jointly connected to said seat, said locking plate comprising braking elements on a face directed toward uprights of said base frame.

13. The chair according to claim 12, wherein the height adjustment means further comprises lower lugs on said vertical sleeves for the pivoting of a release lever with a cam-shaped end, wherein said cam-shaped end is adapted to engage an end of said locking plate for spacing said locking plate from said uprights, such that said vertical sleeves can slide on said uprights.

14. The chair according to claim 10, wherein said seat comprises an inner portion and an outer portion telescopically connected to said inner portion, and wherein said inner portion comprises:

tubular guiding elements having positioning holes;

a first locking pin insertable into said positioning holes of said tubular guiding elements;

an interlocking lamina for pushing said first locking pin; and an internal tubular element associated with the outer portion of said seat for accommodating said interlocking lamina.

15. The chair according to claim 12, further comprising a footrest, detachably connected with said uprights of said base frame, wherein the footrest comprises:

a supporting surface,

L-shaped angular brackets to which said supporting surface is fixed, said angular brackets being engageable to said uprights, a second locking pin insertable into positioning holes of said uprights, a U-shaped lamina, and end of said U-shaped lamina being associated with said second locking pin, and a lateral crossmember for accommodating said U-shaped lamina, wherein said lateral cross member supports said footrest and can be actuated by means of an actuation button accessible from the outside.

* * * * *